United States Patent [19]

Castro

[11] Patent Number: 5,074,218

[45] Date of Patent: Dec. 24, 1991

[54] GRENADE WITH DUAL FUSES FOR SIMULATING SMALL ARMS FIRE

[76] Inventor: Joseph Castro, P.O. Box 786, Trujillo Alto, P.R. 00977

[21] Appl. No.: 395,968

[22] Filed: Aug. 18, 1989

[51] Int. Cl.[5] ..... F42B 8/26

[52] U.S. Cl. ..... 102/498; 102/357; 102/395; 102/482; 102/487; 102/489

[58] Field of Search ..... 102/334, 340, 342, 351, 102/357, 368, 369, 395, 404, 482–487, 489, 498, 505, 275.3, 275.4, 275.5, 275.6

[56] References Cited

U.S. PATENT DOCUMENTS

| | | | |
|---|---|---|---|
| 827,939 | 8/1906 | Pain | 102/341 |
| 3,372,641 | 3/1968 | Foster | 102/334 |
| 3,782,285 | 1/1974 | Froehner | 102/340 |
| 3,841,219 | 10/1974 | Schillreff | 102/505 |
| 4,436,034 | 3/1984 | Jacobsen et al. | 102/334 |
| 4,444,111 | 4/1984 | Luebbers | 102/334 |

*Primary Examiner*—Harold J. Tudor

[57] ABSTRACT

A grenade with dual fuses for simulating small arms fire comprises: a hollow cylindrical housing including a first threaded end and a second open end; a main filler charge being located within the housing proper; means for covering the end of the main filler charge which is adjacent the housing open end; means being compressively connected to the housing open end for securing the main filler charge within the housing; a main igniting fuse being fitted onto the housing threaded end; a cup shaped member being located inside the housing in between the main igniting fuse and the main filter charge; a propelling charge being located in between the cup shaped member, the housing threaded end, and the main igniting fuse; a first straight fuse being responsive to the main igniting fuse and being located in between the main igniting fuse and the main filler charge; a second L-shaped fuse being responsive to the main igniting fuse and being located in between the main igniting fuse, the propelling charge, and the cup shaped member, the first fuse igniting the main filler charge after the second fuse ignites the propelling charge such that the already ignited propelling charge ejects the main filler charge along with the already ignited first fuse from the housing via the housing open end only before the first fuse has ignited the main filler charge. A feature of the invention is that the propelling charge is an annular cylinder.

9 Claims, 1 Drawing Sheet

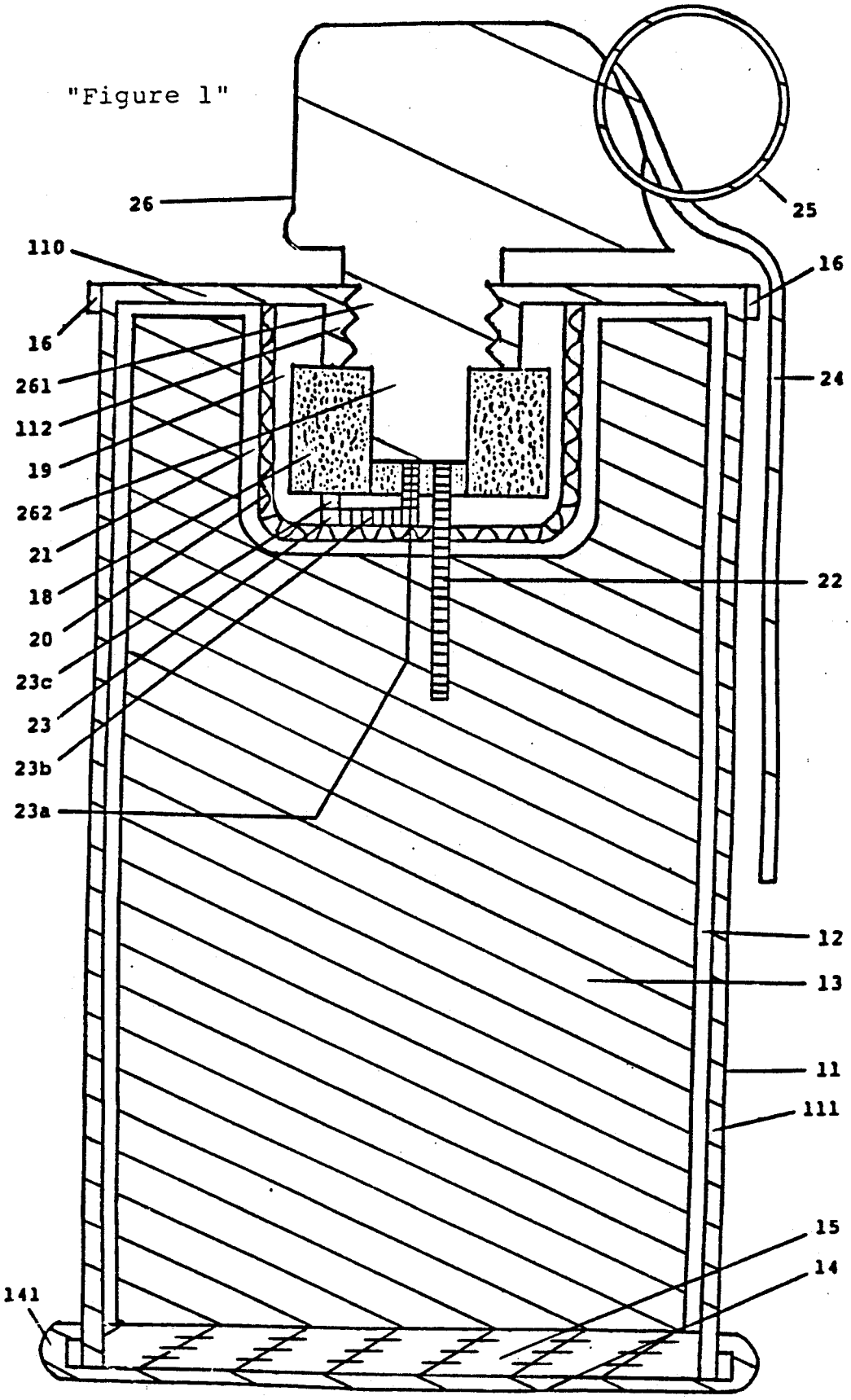
"Figure 1"
26
25
110
16
16
261
112
19
262
21
18
20
23c
23
23b
23a
24
22
12
13
11
111
15
14
141

GRENADE WITH DUAL FUSES FOR SIMULATING SMALL ARMS FIRE

CROSS-REFERENCE TO RELATED APPLICATIONS

This application relates to application Ser. No. 06/573,858 filed on Feb. 1, 1984, and being entitled "Small Arms Fire Grenade", now abandoned and application Ser. No. 06/697,071 filed on Jan. 31, 1985 and being entitled "Grenade With dual Fuses For Simulating Small Arms Fire", now abandoned.

1. Field of the Invention

This invention relates to grenades and in particular to grenades which have dual fuses to simulate small arms fire.

2. Brief Summary of the Invention

A grenade with dual fuses for simulating small arms fire comprises: a hollow cylindrical housing including a first internally threaded end and a second open end; a main filler charge being located within the housing proper; circular means for covering the end of the main filler charge which is adjacent the housing open end; circular mean being compressively connected to the lateral cylindrical surface of the housing open end for securing the main filler charge within the housing; a main igniting fuse including an externally threaded section and a cylindrical section and being fitted onto the housing threaded end; a cup shaped member having its open end facing the housing threaded end and being located inside the housing in between the main igniting fuse and the main filler charge; an annular cylindrical propelling charge being located in between the cup shaped member, the housing threaded end, the main igniting fuse threaded end, and the main igniting fuse cylindrical section, a first straight fuse being responsive to the main igniting charge for igniting the main filler charge and connecting the main igniting charge cylindrical section via the cup shaped member to the main filler charge; and a second L-shaped fuse being responsive to the main igniting fuse for igniting the propelling charge and connecting the main igniting fuse cylindrical section to the propelling charge; wherein the first fuse ignites the main filler charge after the second fuse ignites the propelling charge such that the already ignited propelling charge ejects the main filler charge along with the already ignited first fuse from the housing via the housing open end only before the first fuse has ignited the main filler charge.

A feature of the present invention is that the propelling charge is an annular cylinder that accommodates in its center the main igniting fuse and the first and second fuses.

An advantage of the present invention is that it is simple and economical to manufacture and assemble.

BRIEF DESCRIPTION OF THE DRAWING

The above and other objects, features, and advantages of the present invention will be better appreciated from the following detailed description and the drawing in which:

FIG. 1 is a side cross sectional view of the grenade with dual fuses according to the present invention.

DETAILED DESCRIPTION AND SPECIFICATIONS OF THE INVENTION

FIG. 1 is a side cross sectional view of grenade 10 with dual fuses according to the present invention. Grenade 10 comprises: hollow cylindrical housing 11 made of sheet metal and including lower hollow cylindrical section 111, upper flat annular section 110, and upper central internally threaded section 112; main filler charge packet 13 such as fire crackers for simulating small arms fire being located within housing 11, there being a space 12 in between main filler charge packet 13 and housing 11; lower circular safety cap 14 being made of plastic or sheet metal and including lateral medially directed lip 141 such that the upper surface of cap 14 is adjacent the lower annular surface of section 111 and such that the medial cylindrical surface of cap 14 is adjacent the lateral cylindrical surface of section 111; lower circular cork element 15 having its lower circular surface adjacent the upper circular surface of cap 14 and having its lateral cylindrical surface adjacent the medial cylindrical surface of section 111; upper annular cylindrical ring 16 having its medial cylindrical surface adjacent the lateral cylindrical surface of section 111 for structural strengthening of section 111; main igniting fuse 26 including safety lever or handle 24 being made of sheet metal, pull ring 25 being made of sheet metal, externally threaded section 261 being threaded onto internally threaded section 112, and central cylindrical section 262; annular cylindrical propelling charge 18 having its upper annular surface adjacent the lower annular surface of section 112 and the lower annular surface of section 261 and having its medial cylindrical surface adjacent the lateral cylindrical surface of section 262; concave upward cup shaped member 20 being made of cardboard or plastic and having its upper annular surface adjacent the lower surface of section 110, space 19 being located in between propelling charge 18, section 112, and cup shaped member 20, and space 21 being continuation of space 12 and being in between cup shaped member 20 and main filler charge packet 13; a first straight fuse 22 having its upper surface adjacent the lower surface of section 262 and having its lower surface adjacent the upper surface of main filler charge packet 13, and having an intermediate part of same going through a hole in cup shaped member 20, such first fuse 22 having a length L1 of about $\frac{3}{4}$ inch, a diameter D1 of about 1/16 inch, and having a burning time T1 of about 3 to 4 seconds; a second L-shaped fuse 23 including first section 23*a* having its upper surface adjacent the lower surface of section 262, also including mid section 23*b*, and including third section 23*c* having its upper surface adjacent the lower surface of propelling charge 18, such second fuse having a length L2 of about $\frac{3}{8}$ inch, a diameter D2 of about 1/16 inch, and a burning time T2 of about 1 to 2 seconds. Main filler charge packet 13 is a unitary cylindrical structure having a U-shaped annular upper end conforming to the shape of concave upward cup shaped member 20 and housing 11 and having a circular lower end being in intimate contact with and being supported by the upper circular surface of lower circular cork element 15, the upper central circular surface of main filler charge packet 13 being in intimate contact with and being supported by the lower surface of first straight fuse 22.

According to the present invention, propelling charge 18 has an outer diameter D3 of about 1 inch, an inner diameter D4 of about $\frac{3}{8}$ inch, and a length L3 of about $\frac{1}{2}$ inch. The rates of burning per unit of length for fuses 22 and 23 are the same and their diameter are the same. Accordingly, the burning time T2 for fuse 23 is shorter than the burning time T1 for fuse 22 in proportion to their respective lengths, there being a minimum difference of about 1 second and a maximum difference of about 2 seconds. Main igniting fuse 26 may be any standard igniting fuse for this purpose having a delay of about 4 to 5 seconds such as Model M205A1 used by the armed services. The minimum combined time for main igniting fuse 26 and first fuse 22 is about 7 seconds and the maximum combined time is about 9 seconds; while the minimum combined time for main igniting fuse 26 and second fuse 23 is about 5 seconds and the maximum combined time is about 7 seconds.

The operation of grenade 10 is as follows: main igniting fuse 26 is turned ON by the pulling off of ring 25 and the letting go of handle 24; main igniting fuse 26 then takes about 4 to 5 seconds to ignite the upper surface of first fuse 22 and the upper surface of second fuse section 23*a;* fuses 22 and 23 continue to burn until the upper surface of the third section of fuse 23 ignites the lower surface of annular cylindrical propelling charge 18; in the meantime fuse 22 continues to burn; eventually the lower surface of fuse 22 ignites the upper surface of main filler charge packet 13 after propelling charge 18 has propelled already ignited fuse 22 and main filler charge packet 13 from housing 11 by displacing element 15 and cap 14 outwardly; thereafter ignited main filler charge packet 13 explodes outside of housing 11 to simulate small arms fire. Grenade 10 may be initially hurled manually about 35 meters or may be projected by rifle about 120 meters as desired.

While the arrangement according to the present invention has been described in terms of a specific illustrative embodiment, it will be apparent to those skilled in the art that many modifications are possible within the spirit and scope of the disclosed principle.

What is claimed is:

1. A grenade with dual fuses for simulating small arms fire comprising:

a housing including a first partially open end and a second fully open end;

a cup shaped member being located within said housing and including a first open end being adjacent to said housing first partially open end and a second closed end being away from said housing first partially open end;

a main filler charge being located within said housing except for that portion being occupied by said cup shaped member;

pliable means for covering said main filler charge at said housing second open end;

means being compressively connected to said housing second open end for securing said main filler charge within said housing;

a main igniting fuse having a delay time T3, being connected to said housing first partially open end, and including an extension being located within said cup shaped member;

a propelling charge being located within said cup shaped member and being surrounded by said cup shaped member, said housing first partially open end, and said main igniting fuse extension;

a first fuse being responsive to said main igniting fuse extension for igniting said main filler charge after a time T1; and a second fuse also being responsive to said main igniting fuse extension for igniting said propelling charge after a time T2 less than T1;

whereby said ignited main filler charge is ejected from said housing along with said already ignited first fuse via said housing second open end by said ignited propelling charge at said time T2 and said ejected main filler charge simulates small arms fire upon exploding outside said housing.

2. The grenade with dual fuses of claim 1 wherein:

said housing first partially open end includes a central hole with an internal thread;

said main igniting fuse extension includes an external thread; and said main igniting fuse externally threaded extension is screwed onto said housing first partially open internally threaded end.

3. The grenade with dual fuses of claim 1 wherein:

said first fuse is a straight fuse connecting said main igniting fuse extension to said main filler charge via a hole in said cup shaped member.

4. The grenade with dual fuses of claim 1 wherein:

said second fuse is an L-shaped fuse including first, second, and third section, said first section connecting said main igniting fuse extension to said second section, said second section connecting said first section to said third section along said cup shaped member, and said third section connecting said second section to said propelling charge.

5. The grenade with dual fuses of claim 1 wherein:

said propelling charge is an annular cylinder including a central hole and having said main igniting fuse extension, said first fuse, and said second fuse located in said central hole.

6. The grenade with dual fuses of claim 1 wherein:

said propelling charge is an annular cylinder including first and second annular surfaces, said housing first partially open end and said main igniting fuse extension being adjacent to said first annular surface, and said second fuse being adjacent to said second annular surface.

7. The grenade with dual fuses of claim 4 wherein:

said propelling charge is an annular cylinder including first and second annular surfaces and a central hole, said housing first partially open end and said main igniting fuse extension being adjacent to said first annular surface, said first fuse and said second fuse first section being adjacent to said main igniting fuse extension within said central hole, and said second fuse third section being adjacent to said second annular surface.

8. The grenade with dual fuses of claim 1 wherein:

said housing is a hollow cylindrical housing and said main filler charge is a unitary packet which is fitted into said housing except for that portion being occupied by said cup shaped member.

9. The grenade with dual fuses of claim 1 wherein:

said first fuse time T1 is about 3 to 4 seconds, said second fuse time T2 is about 1 to 2 seconds, and said main igniting fuse delay time T3 is about 4 to 5 seconds.

* * * * *

UNITED STATES PATENT AND TRADEMARK OFFICE
CERTIFICATE OF CORRECTION

PATENT NO. : 5,074,218

DATED : December 24, 1991

INVENTOR(S) : Joseph Castro

It is certified that error appears in the above-identified patent and that said Letters Patent is hereby corrected as shown below:

The title page should be deleted to be replaced with the attached title page.

The sheet of drawing consisting of Figure 1, should be deleted to be replaced with the attached sheet.

Signed and Sealed this

Twentieth Day of July, 1993

*Attest:*

Michael K. Kirk

MICHAEL K. KIRK

*Attesting Officer*

*Acting Commissioner of Patents and Trademarks*

United States Patent [19]

Castro

[11] Patent Number: 5,074,218

[45] Date of Patent: Dec. 24, 1991

[54] GRENADE WITH DUAL FUSES FOR SIMULATING SMALL ARMS FIRE

[76] Inventor: Joseph Castro, P.O. Box 786, Trujillo Alto, P.R. 00977

[21] Appl. No.: 395,968

[22] Filed: Aug. 18, 1989

[51] Int. Cl.[5] ..... F42B 8/26

[52] U.S. Cl. ..... 102/498; 102/357; 102/395; 102/482; 102/487; 102/489

[58] Field of Search ..... 102/334, 340, 342, 351, 102/357, 368, 369, 395, 404, 482–487, 489, 498, 505, 275.3, 275.4, 275.5, 275.6

[56] References Cited

U.S. PATENT DOCUMENTS

| | | | |
|---|---|---|---|
| 827,939 | 8/1906 | Pain | 102/341 |
| 3,372,641 | 3/1968 | Foster | 102/334 |
| 3,782,285 | 1/1974 | Froehner | 102/340 |
| 3,841,219 | 10/1974 | Schillreff | 102/505 |
| 4,436,034 | 3/1984 | Jacobsen et al. | 102/334 |
| 4,444,111 | 4/1984 | Luebbers | 102/334 |

*Primary Examiner*—Harold J. Tudor

[57] ABSTRACT

A grenade with dual fuses for simulating small arms fire comprises: a hollow cylindrical housing including a first threaded end and a second open end; a main filler charge being located within the housing proper; means for covering the end of the main filler charge which is adjacent the housing open end; means being compressively connected to the housing open end for securing the main filler charge within the housing; a main igniting fuse being fitted onto the housing threaded end; a cup shaped member being located inside the housing in between the main igniting fuse and the main filter charge; a propelling charge being located in between the cup shaped member, the housing threaded end, and the main igniting fuse; a first straight fuse being responsive to the main igniting fuse and being located in between the main igniting fuse and the main filler charge; a second L-shaped fuse being responsive to the main igniting fuse and being located in between the main igniting fuse, the propelling charge, and the cup shaped member, the first fuse igniting the main filler charge after the second fuse ignites the propelling charge such that the already ignited propelling charge ejects the main filler charge along with the already ignited first fuse from the housing via the housing open end only before the first fuse has ignited the main filler charge. A feature of the invention is that the propelling charge is an annular cylinder.

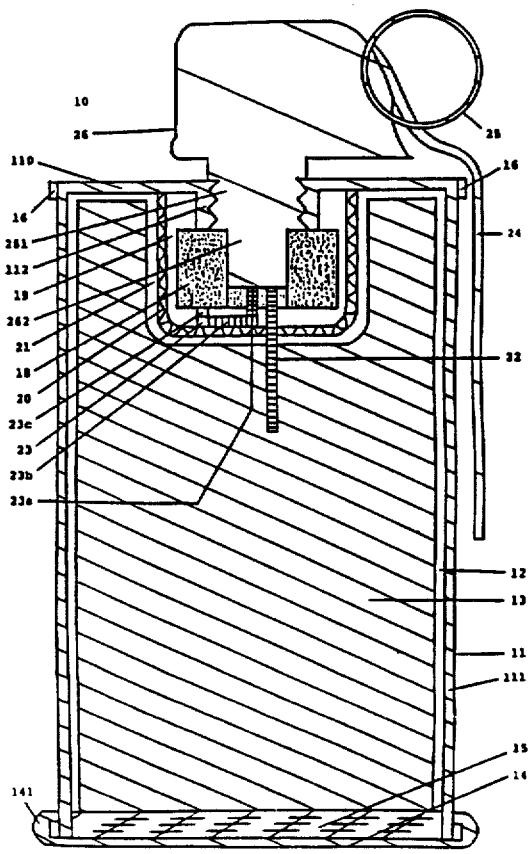

"Figure 1"
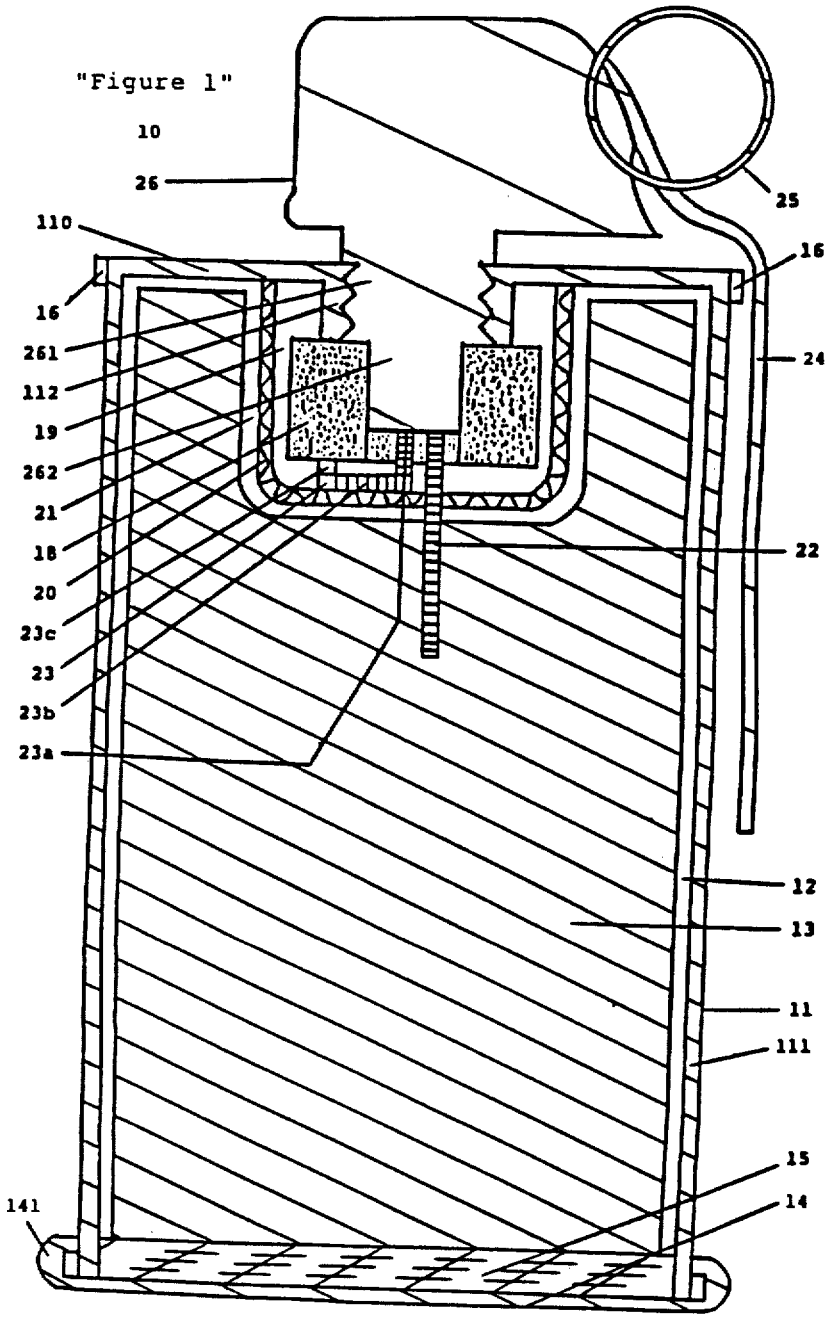

9 Claims, 1 Drawing Sheet